US012790087B2

(12) United States Patent
Baumgärtner

(10) Patent No.: US 12,790,087 B2
(45) Date of Patent: Nov. 10, 2026

(54) SYSTEM, COMPRISING AN INNER CONTAINER AND AN OUTER CONTAINER

(71) Applicant: SAUERLAND LIQUIDS GMBH, Meinerzhagen (DE)

(72) Inventor: Uwe Baumgärtner, Schmallenberg (DE)

(73) Assignee: SAUERLAND LIQUIDS GMBH, Meinerzhagen (DE)

( * ) Notice: Subject to any disclaimer, the term of this patent is extended or adjusted under 35 U.S.C. 154(b) by 37 days.

(21) Appl. No.: 18/716,745

(22) PCT Filed: Jun. 14, 2023

(86) PCT No.: PCT/EP2023/065943
§ 371 (c)(1),
(2) Date: Jun. 5, 2024

(87) PCT Pub. No.: WO2023/247285
PCT Pub. Date: Dec. 28, 2023

(65) Prior Publication Data

US 2025/0042632 A1 Feb. 6, 2025

(30) Foreign Application Priority Data

Jun. 24, 2022 (DE) ..... 102022115798.9

(51) Int. Cl.
*B65D 51/28* (2006.01)

(52) U.S. Cl.
CPC ..... *B65D 51/2885* (2013.01)

(58) Field of Classification Search
CPC ..... B65D 81/3222; B65D 51/2885; B65D 51/28; B65D 51/20
USPC ..... 222/548
See application file for complete search history.

(56) References Cited

U.S. PATENT DOCUMENTS

| | | | |
|---|---|---|---|
| 4,386,696 | A | 6/1983 | Goncalves |
| 6,047,818 | A | 4/2000 | Warby et al. |
| 2020/0245818 | A1 | 8/2020 | Halkes et al. |

FOREIGN PATENT DOCUMENTS

| | | |
|---|---|---|
| EP | 0190593 | 10/1988 |
| EP | 2190751 | 2/2013 |
| FR | 1562857 | 4/1969 |
| GB | 2523797 | 9/2015 |

*Primary Examiner* — Anthony D Stashick
*Assistant Examiner* — L Kmet
(74) *Attorney, Agent, or Firm* — Renner, Kenner, Greive, Bobak, Taylor & Weber

(57) ABSTRACT

An inner container includes a first interior surrounded by a first wall, a circumferential collar protruding outward therefrom. An outer container having a lid fastenable thereto includes a second interior surrounded by a second wall. When the inner container is disposed in the second interior, the first and second opening regions are covered by the lid when the screw connection is established. The screw connection defines a virtual center axis; the outer container includes a cross-section tapering means disposed in a virtual plane and disposed in the second opening region and protruding inward from the second wall. Rotation of the inner container about the center axis is blocked when the collar is disposed in the virtual plane. The inner container includes a driver element protruding away from the collar toward the cross-section tapering means when the screw connection is established.

10 Claims, 2 Drawing Sheets

SYSTEM, COMPRISING AN INNER CONTAINER AND AN OUTER CONTAINER

Figure 1:
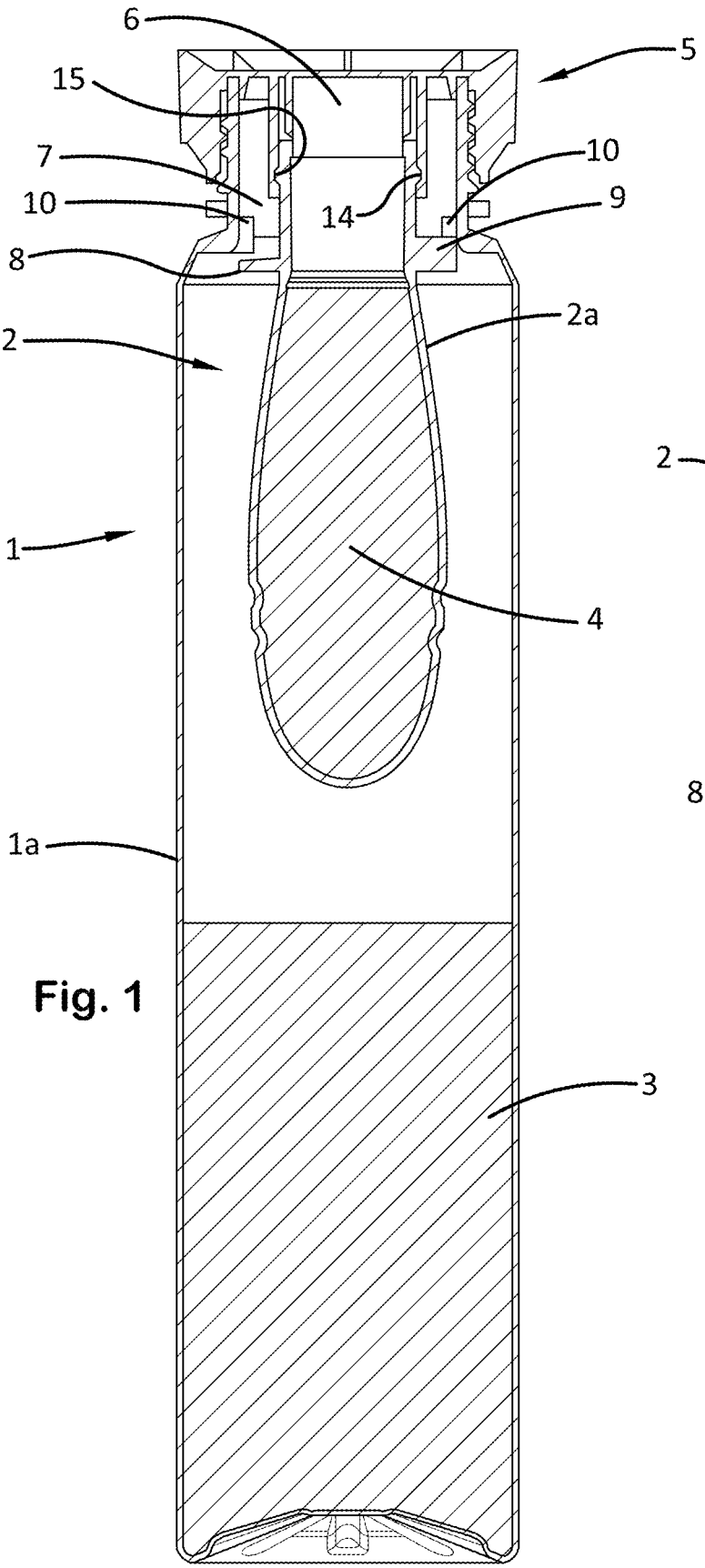

The invention relates to a system, comprising an inner container and an outer container according to claim 1.

DE 20 2020 105 068 U1 discloses a system with an inner container and an outer container. The inner container is disposed in the outer container. Both the inner container and the outer container are closed by a single screw cap, which is screwed onto the outer container. When the screw connection is loosened, the screw cap moves to a release position. By pressing on a lid region of the screw cap in the release position, the inner container can be released so that it falls down. The liquid in the inner container can then mix with the liquid in the outer container.

In contrast, the present invention is based on the object of creating an improved system. In addition, a method for assembling such a system is to be created.

The object is achieved by a system according to claim 1 and by a method according to claim 9. Embodiments of the invention are indicated in the dependent claims.

The system comprises an inner container and an outer container. The inner container comprises a first interior surrounded by a first wall and a circumferential collar protruding outward away from the first wall. The outer container comprises a second interior surrounded by a second wall. The inner container can be disposed in the second interior, i.e. inside the outer container.

The first interior is fluidically connected to a surrounding area of the system via a first opening region. The second interior is fluidically connected to the surrounding area via a second opening region. Within the framework of this description, a fluidic connection is understood to mean in particular that a fluid exchange is possible. Thus, a fluid can flow through the opening region into the surrounding area or vice versa. The system comprises a lid that can be fastened to the outer container with a screw connection. The first and second opening regions are covered by the lid in the state of the inner container disposed in the second interior when the screw connection has been established. Thus, both opening regions are covered with a single lid in this state. For this purpose, the lid can be attached to the inner container, for example. The screw connection defines a virtual center axis. Within the framework of this description, the term "virtual" means in particular that the feature thus designated does not actually exist as a component, but is merely used to describe or define various functions or arrangements. The center axis is the axis around which a rotation of the lid is carried out when the screw connection is established.

For the purposes of this description, the terms "inside" and "outside" refer in particular to the position in relation to the virtual center axis. The virtual center axis represents the center, i.e. the innermost region.

The outer container comprises a cross-section tapering center means disposed in the second opening region and protruding inward from the second wall. In particular, the cross-section tapering means can taper a continuous cross-section in the second opening region. In this case, for example, the continuous cross-section in the opening region can be the smallest where the cross-section tapering means is disposed.

The cross-section tapering means is disposed in a virtual plane. Preferably, the normal vector of this virtual plane can be disposed on the center axis or parallel to the center axis. Rotation of the inner container around the center axis is blocked when the collar is disposed in the virtual plane. It should be noted that, in practice, a slight rotation may still be possible under certain circumstances due to tolerances.

The inner container comprises a driver element that protrudes from the collar in the direction of the cross-section tapering means away from the collar when the screw connection is established. This applies in particular when the screw connection is completely established, i.e. when the lid can no longer be screwed more tightly onto the outer container without damaging components. In particular, it is possible that the driver element protrudes vertically away from the collar, for example parallel to the center axis.

In particular, the first and second opening regions can be disposed in a respective bottle neck when the inner and outer container are each a bottle. In addition, the second opening region can be located in the region of the thread with which the lid is fastened to the outer container.

The interaction of the collar and the driver element with the cross-section tapering means is particularly advantageous. Due to the collar and the cross-section tapering means, the inner container can only be inserted into the second interior in one or more defined orientations. If the screw connection is then established and the lid fastened to the inner container, for example by means of a plug-in connection, is rotated, the driver element engages with the cross-section tapering means so that rotation of the inner container is prevented. The lid is thus twisted relative to the inner container.

If the screw connection is then loosened again, the driver element or the collar comes into contact with the cross-section tapering means due to the twisting, without the driver element or the collar being able to pass through the cross-section tapering means. The force generated due to the loosening of the screw connection loosens the fastening of the lid to the inner container, so that the inner container falls freely into the second interior. The first opening region is then no longer covered. A substance disposed in the inner container can then mix with a substance disposed in the second interior.

For example, two liquids can be mixed together in this way if a user wishes to mix them just before consumption. However, it is also possible, for example, to arrange a powder in the first interior and a liquid, such as water, in the second interior. This can be advantageous, for example, in order to mix the powder and water just before use. It is possible, for example, that the mixture does not have a long shelf life, as is the case with some pharmaceuticals, whereas the powder and water each have a very long shelf life when isolated.

The way in which the lid is loosened from the inner container when the screw connection is loosened is particularly advantageous. No pressure is required on the lid. This is particularly advantageous when transporting the system. It is not necessary to avoid pressure on the lid. In addition, a user can simply and intuitively loosen the screw connection. Furthermore, the risk of components breaking off is particularly low due to the shape of the surrounding collar.

According to one embodiment of the invention, the driver element can come into engagement with the cross-section tapering means when the screw connection is established and cause a twisting of the inner container relative to the lid. This twisting may be the reason why the screw connection can no longer be loosened without first removing the lid from the inner container.

According to one embodiment of the invention, the inner container can be free of a thread. Such a thread is not necessary, since the lid can be fastened to the inner container with a plug-in connection, for example.

According to one embodiment of the invention, the lid can have an internal thread and the outer container an external thread. The screw connection can be established using the internal thread and the external thread.

According to one embodiment of the invention, the inner container can be freely rotatable about the center axis when the screw connection is established, as soon as the driver element is without contact to the cross-section tapering means.

According to one embodiment of the invention, the lid can be fastened to the inner container by means of a plug-in connection. This is particularly advantageous, since the plug-in connection can be easily loosened by exerting a force on the collar or the driver element when the screw connection is loosened, because the collar or the driver element cannot be guided through the cross-section tapering means.

According to one embodiment of the invention, the collar can have an outer border, whose contour corresponds to an inner border of the cross-section tapering means. Of course, this also only applies if tolerances are taken into account when manufacturing the system.

According to one embodiment of the invention, the outer border can comprise two partial circular sections and two non-curved sections. The partial circular sections can, for example, only be sections of a circumference. The non-curved sections can, for example, be free of a curvature. The partial circular sections can be separated from one another by the non-curved sections. The same can also apply the other way round in this case, namely that the non-curved sections are separated from one another by the partial circular sections.

With the method according to claim 9, a connection, for example a plug-in connection, is initially established between the lid and the inner container. The inner container is then inserted into the second interior. The collar is guided through the cross-section tapering means. For example, the inner container can be inserted into the second interior until the inner thread of the lid comes into contact with the outer thread of the outer container. The screw connection between the lid and the outer container is then established. During the establishment of the screw connection, the driver element comes into engagement with the cross-section tapering means and causes a twisting of the inner container relative to the lid.

According to one embodiment of the invention, the screw connection can be loosened. When the screw connection is loosened, the driver element or the collar can come into contact with the cross-section tapering means in a position in which the collar or the driver element cannot be guided through the cross-section tapering means. This can be caused, for example, by the inner container being twisted relative to the lid when the screw connection is established. By further loosening the screw connection, the connection between the inner container and the lid can then be loosened, so that the inner container can move freely in the second interior space and fluid can be exchanged between the first and second interiors.

Figure 2:
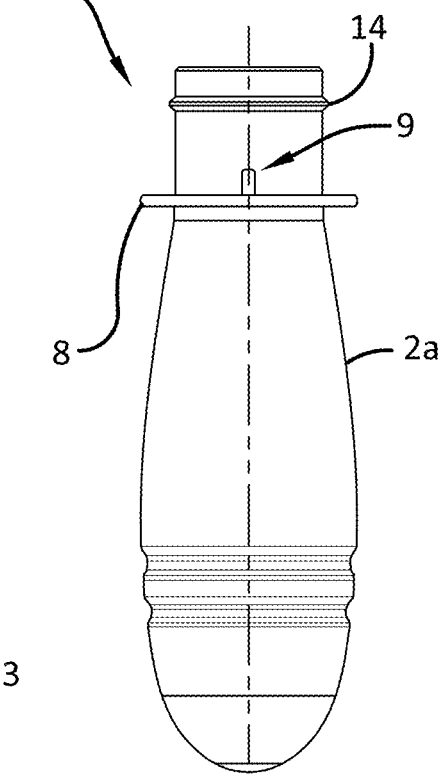
Figure 3:
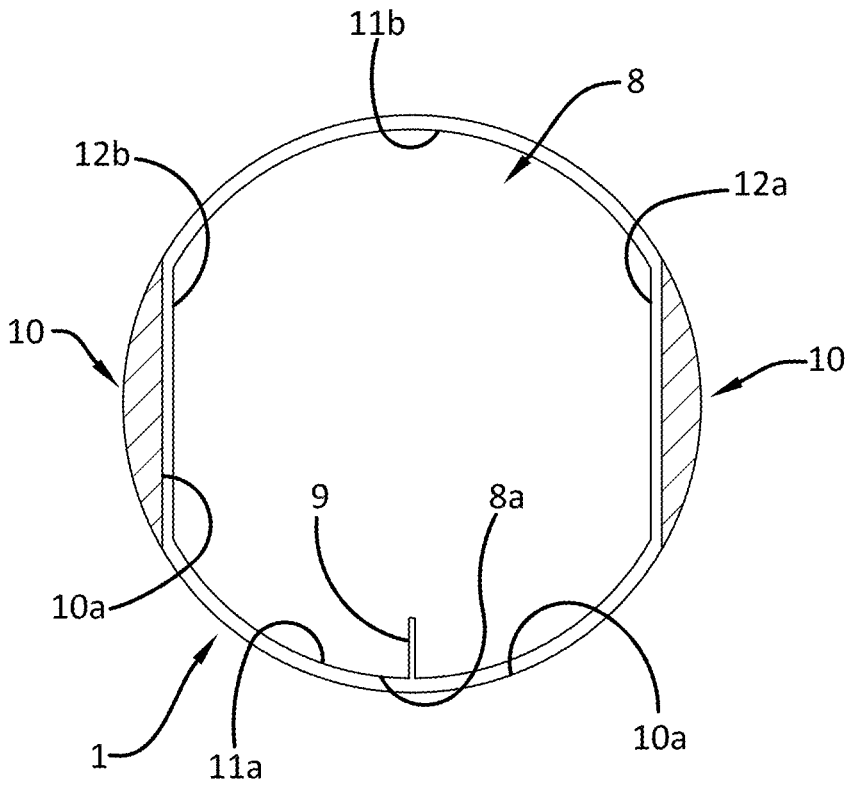

Further features and advantages of an embodiment of the invention are described below with reference to the drawings. The same reference signs are used for identical or similar parts and for parts with identical or similar functions. The following are shown:

FIG. 1 a schematic sectional view of a system according to one embodiment of the invention in the assembled state;

FIG. 2 a schematic side view of the inner container of the system in FIG. 1; and FIG. 3 is a schematic top plan cross section showing the interaction of a collar 8 of the inner container 2 and the cross section tapering means 10 of the outer container 1.

It is not necessary for a device according to the invention to have all the features described below. It is also possible for a device according to the invention to have only individual features of the exemplary embodiment described below.

The system comprises an outer container 1 and an inner container 2. A first wall 2*a* of the inner container 2 surrounds a first interior 4, in which a first liquid is disposed. A second wall 1*a* of the outer container 1 surrounds a second interior 3, in which a second liquid is disposed. The inner container 2 has a first opening region 6. The outer container 1 has a second opening region 7. Both the first opening region 6 and the second opening region 7 are closed by a lid 5. If the lid 5 is loosened, the first interior 4 is in fluidic connection with a surrounding area of the system via the first opening region 6 and the second interior 3 via the second opening region 7. A circumferential collar 8 protrudes outward from the first wall of the inner container 2.

The lid 5 is fastened to the outer container 1 with a screw connection. The lid 5 is fastened to the inner container 2 with a plug-in connection. The plug-in connection is a positive-locking connection, namely a snap-in connection. A circumferential edge 14 of the inner container 2 is disposed within a circumferential groove 15 of the lid. The connection can be loosened by deforming the lid 5.

The inner container 2 and the outer container 1 are closed by initially establishing the plug-in connection between the lid 5 and the inner container 2. The lid 5 is then placed on the outer container 1 and, at the same time, the inner container 2 is inserted into the second interior 3. This is only possible when the collar 8 is guided through a cross-section tapering means 10 protruding inward from the wall of the outer container 1 in the second opening region 7. The outer border of the collar 8 and the inner border 10*a* of the cross-section tapering means are matched to one another in such a way that the inner container 2 can only be guided through in one or more predefined orientations relative to the outer container 1. At the moment when the collar 8 is disposed in a plane with the cross-section tapering means 10 (see FIG. 3), a twisting of the inner container 2 relative to the outer container 1 is no longer possible, apart from tolerances.

If the collar 8 has been guided through the cross-section tapering means 10, the external thread of the outer container 1 and the internal thread of the lid 5 come into contact with one another so that the screw connection between the lid 5 and the container 1 can begin to be established. This requires a rotation of the lid 5 relative to the outer container 1, which is possible, because the collar 8 is disposed below the cross-section tapering means.

However, a driver element 9 projects vertically from the collar 8. If the inner container 2 is disposed in the second interior 3 as in FIG. 1, the driver element 9 protrudes toward the cross-section tapering means. The rotational movement of the lid 5 relative to the outer container 1 causes a twisting of the inner container 2 relative to the outer container 1, since the lid 5 and the inner container 2 are connected to one another. As soon as the driver element 9 strikes the cross-section tapering means, further twisting of the inner container 2 relative to the outer container 1 is no longer possible, so that the inner container 2 is twisted relative to the lid 5 when the lid 5 is screwed further onto the outer container 1.

According to one embodiment of the invention shown schematically in FIG. 3, the outer border (8*a*) can comprise two partial circular sections (11*a*), (11*b*) and two non-curved sections (12*a*), (12*b*). The partial circular sections (11*a*), (11*b*) can, for example, only be sections of a circumference. The non-curved sections (12*a*), (12*b*) can, for example, be free of a curvature. The partial circular sections (11*a*), (11*b*) can be separated from one another by the non-curved sections (12*a*), (12*b*). The same can also apply the other way round in this case, namely that the non-curved sections are separated from one another by the partial circular sections.

If the screw connection between the lid 5 and the outer container 1 is completely established, the state shown in FIG. 1 is achieved. If a user now wishes to consume the two liquids disposed in the first inner compartment 4 and the second inner compartment 3, they begin to loosen the screw connection by rotating the lid 5 relative to the outer container 1. Due to the twisting of the inner container 2 relative to the lid 5 when the screw connection is established, the collar 8 can no longer be guided through the cross-section tapering means when the screw connection is loosened. The collar 8 comes into contact with the cross-section tapering means and blocks movement of the inner container 2 out of the second interior 3. If the screw connection is loosened further, an ever-increasing force acts on the collar 8, which leads to a deformation of the lid, so that the connection between the lid 5 and the inner container 2 is loosened.

Since the inner container 2 has no further fastening, it can move freely in the second interior, and the liquids are exchanged in the first interior 4 and the second interior 3. The lid 5 can then be removed from the outer container 1 by further loosening the screw connection, as with a normal container, so that the user can consume the mixed liquids.

The invention claimed is:

1. A system comprising:

an inner container (2) including:

a first interior (4), which is surrounded by a first wall (2*a*);

a circumferential collar (8) extending outwardly away from the first wall (2*a*) to an outer border (8*a*), and a driver element (9) extending from the circumferential collar (8), the first interior (4) being fluidically connected to a surrounding area of the system via a first opening region (6);

an outer container (1) including:

a second interior (3), which is surrounded by a second wall (3*a*), the second interior (3) being fluidically connected to the surrounding area via a second opening region (7) that includes a shaped section, wherein the outer border (8*a*) of the circumferential collar (8) is shaped such that the inner container (2) can only be fully inserted in the second interior (3) when the circumferential collar (8) is in one or more predefined orientations relative to the outer container (1), permitting the circumferential collar (8) to be inserted past the shaped section; and a lid (5) that can be fastened to the outer container (1) and rotate relative thereto about an axis of rotation through a rotational connection:

wherein the inner container is releasably carried by the lid and can rotate relative to the axis of rotation, wherein, when the inner container (2) carried by the lid is inserted in the second interior (3), with the circumferential collar inserted past the shaped section, (a) the rotational connection is established, (b) the first opening region and the second opening region are covered by the lid (5) and (c) the driver element (9) protrudes away from the circumferential collar (8) upwardly toward the shaped section, and wherein rotation of the inner container (2) about the axis of rotation is blocked when the driver element (9) comes into contact with the shaped section or the circumferential collar is vertically disposed in the shaped section.

2. The system according to claim 1, characterized in that the driver element (9) comes into engagement with the shaped section when the rotational connection is established and the lid is rotated, and this causes a rotation of the inner container (2) relative to the lid (5).

3. The system according to claim 1, characterized in that the inner container (2) is free of a thread.

4. The system according to claim 1, characterized in that the lid (5) has an internal thread and the outer container (1) has an external thread, wherein the rotational connection is established by engagement of the internal thread and the external thread.

5. The system according to claim 1, characterized in that the inner container (2) is freely rotatable about the axis of rotation when the rotational connection is established and (a) the driver element (9) is without contact to the shaped section and (b) the circumferential collar is not disposed in the shaped section.

6. The system according to claim 1, characterized in that the lid (5) is releasable fastened to the inner container (2) by plug-in connection.

7. The system according to claim 1, characterized in that the outer border has a contour that corresponds to an inner border of the shaped section.

8. The system according to claim 7, characterized in that the outer border comprises two partial circular sections and two non-curved sections, wherein the partial circular sections are separated from one another by the non-curved sections.

9. A method for assembling a system according to claim 1, comprising the following steps:

Establishing a connection between the lid (5) and the inner container (2); then Inserting the inner container (2) into the second interior (3), wherein the collar (8) is inserted past the shaped section to establish the rotational connection; and thereafter Rotating the lid (5) whereby the driver element (9) comes into engagement with the shaped section and causes a rotation of the inner container (2) relative to the lid (5).

10. The method according to claim 9, characterized in that the rotational connection is a threaded connection, and, as the threaded connection is loosened, the driver element (9) comes into contact with the shaped section in a position in which the collar (8) cannot be guided through the shaped section such that, upon further loosening of the threaded connection, the connection between the inner container (2) and the lid (5) is loosened as the lid travels upwardly on the threads away from the inner container retained by the shaped section.

* * * * *